US008903284B2

(12) United States Patent
Shimizu et al.

(10) Patent No.: US 8,903,284 B2
(45) Date of Patent: Dec. 2, 2014

(54) DEVELOPER STORAGE CONTAINER WITH A CONVEYOR MEMBER THAT SIMULTANEOUSLY CONVEYS TONER IN OPPOSITE DIRECTIONS AND IMAGE FORMING APPARATUS WITH THE SAME

(71) Applicant: KYOCERA Document Solutions Inc., Osaka-shi, Osaka (JP)

(72) Inventors: Tamotsu Shimizu, Osaka (JP); Takahisa Nakaue, Osaka (JP); Teruhiko Nagashima, Osaka (JP); Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 33 days.

(21) Appl. No.: 13/657,005

(22) Filed: Oct. 22, 2012

(65) Prior Publication Data

US 2013/0101318 A1 Apr. 25, 2013

(30) Foreign Application Priority Data

Oct. 24, 2011 (JP) ..... 2011-233039

(51) Int. Cl.
*G03G 15/08* (2006.01)

(52) U.S. Cl.
CPC ..... *G03G 15/0868* (2013.01); *G03G 15/0875* (2013.01); *G03G 2215/0827* (2013.01); *G03G 2215/0833* (2013.01)
USPC ..... 399/263; 399/254; 399/258; 399/260; 399/262

(58) Field of Classification Search
USPC ..... 399/263, 254, 258, 260, 262
See application file for complete search history.

(56) References Cited

U.S. PATENT DOCUMENTS

| | | | | |
|---|---|---|---|---|
| 3,439,836 | A * | 4/1969 | Ricciardi | 222/240 |
| 3,724,725 | A * | 4/1973 | Stauffer | 399/62 |
| 4,273,267 | A * | 6/1981 | Conca | 222/318 |
| 4,739,907 | A * | 4/1988 | Gallant | 222/240 |

(Continued)

FOREIGN PATENT DOCUMENTS

| | | |
|---|---|---|
| JP | 5-46021 | 2/1993 |
| JP | 2006-251067 | 9/2006 |

OTHER PUBLICATIONS

Machine Translation of Kinoshita, JP2006-251067, Published Sep. 21, 2006.*

*Primary Examiner* — Clayton E Laballe
*Assistant Examiner* — Trevor J Bervik
(74) *Attorney, Agent, or Firm* — Gerald E. Hespos; Michael J. Porco; Matthew T. Hespos

(57) ABSTRACT

A developer storage container includes a container main body, a tubular portion projecting from the container main body and including a developer discharge opening, and a rotary member extending from the container main body to the tubular portion and having a function of conveying the developer in the container main body. The rotary member includes a first section located in the container main body and a second section located in the tubular portion. A first conveying member for conveying the developer from the tubular portion side toward the container main body side, a second conveying member for conveying the developer in an opposite direction, and a flexible member are mounted on the rotary shaft. The flexible member includes a fixed end portion fixed onto the circumferential surface of the rotary shaft and a free end portion arranged at a side radially outward of the second conveying member.

19 Claims, 14 Drawing Sheets

(56) References Cited

U.S. PATENT DOCUMENTS

| | | | | |
|---|---|---|---|---|
| 6,385,422 | B1 * | 5/2002 | Ishiguro et al. | 399/258 |
| 7,272,346 | B2 * | 9/2007 | Ito | 399/263 |
| 7,817,943 | B2 * | 10/2010 | Utsumi et al. | 399/254 |
| 7,912,408 | B2 * | 3/2011 | Iwata et al. | 399/239 |
| 8,666,292 | B2 * | 3/2014 | Shimizu et al. | 399/258 |
| 8,693,927 | B2 * | 4/2014 | Morita | 399/263 |
| 2008/0199222 | A1 | 8/2008 | Nakajima | |
| 2010/0111574 | A1 | 5/2010 | Ichikawa | |
| 2011/0081171 | A1 | 4/2011 | Kimura et al. | |
| 2011/0229213 | A1 | 9/2011 | Mihara et al. | |

* cited by examiner

DEVELOPER STORAGE CONTAINER WITH A CONVEYOR MEMBER THAT SIMULTANEOUSLY CONVEYS TONER IN OPPOSITE DIRECTIONS AND IMAGE FORMING APPARATUS WITH THE SAME

This application is based on Japanese Patent Application Serial No. 2011-233039 filed with the Japan Patent Office on Oct. 24, 2011, the contents of which are hereby incorporated by reference.

BACKGROUND

The present disclosure relates to a developer storage container for storing a developer and an image forming apparatus mounted with the developer storage container.

A developer storage container such as a toner container is arranged in an image forming apparatus for forming an image on a sheet using a developer. The toner container is a container for storing a toner (developer) to be supplied to a developing device, and is mounted in the image forming apparatus in a state attachable and detachable by a user. Generally, the toner container includes a container main body which serves as a toner storage space, a toner discharge opening provided at a suitable position of the bottom wall of the container main body and a conveyor screw for conveying the toner toward this toner discharge opening. Further, the conveyor screw is known to have a double structure composed of an inner side and an outer side.

In the case of arranging the conveyor screw having the double structure as described above in the toner container, the conveyor screw conveys the toner in a conveying direction toward the toner discharge opening and, simultaneously, conveys a part of the toner in a direction opposite to the conveying direction. In this case, the toner is conveyed in opposite directions near the outer periphery of the conveyor screw and in an inner part. Under a condition that the fluidity of the toner in the toner container is poor, the toner in a cylindrical space formed by the rotation of the conveyor screw flows and the toner located outside that space has trouble flowing in some cases. As a result, there has been a problem that the toner in the toner container is condensed in a tunnel-like manner.

An object of the present disclosure is to provide a developer storage container capable of suppressing the tunnel-like condensation of a developer stored in a container main body and an image forming apparatus to which this developer storage container is applied.

SUMMARY

A developer storage container according to one aspect of the present disclosure includes a container main body, a tubular portion and a rotary member. The container main body includes a bottom wall extending in one direction and stores a developer. The tubular portion projects from the container main body while being connected to the bottom wall, and includes a developer discharge opening. The rotary member extends from the container main body to the tubular portion and has a function of conveying the developer in the container main body. The rotary member includes a rotary shaft, a first conveying member, a second conveying member and a flexible member. The rotary shaft extends in an extending direction of the bottom wall and includes a first section located in the container main body and a second section located in the tubular portion. The first conveying member is arranged on the circumferential surface of the second section of the rotary shaft and rotates together with the rotary shaft and conveys the developer in a first conveying direction from the tubular portion toward the container main body. The second conveying member is arranged around the first section and at a side radially outward of the first conveying member and rotates together with the rotary shaft and conveys the developer in a second conveying direction from the container main body toward the tubular portion. The flexible member extends from the circumferential surface of the first section of the rotary shaft in a direction perpendicular to an axial direction of the rotary shaft and includes a fixed end portion fixed onto the circumferential surface of the rotary shaft and a free end portion arranged at a side radially outward of the second conveying member.

An image forming apparatus according to another aspect of the present disclosure includes an image bearing member for bearing a developer image on the circumferential surface thereof, a developing device including a developing roller for supplying the developer to the circumferential surface of the image bearing member, and the above developer storage container to be assembled with the developing device for supplying the developer to the developing device.

These and other objects, features and advantages of the present disclosure will become more apparent upon reading the following detailed description along with the accompanying drawings.

DETAILED DESCRIPTION

Figure 1:
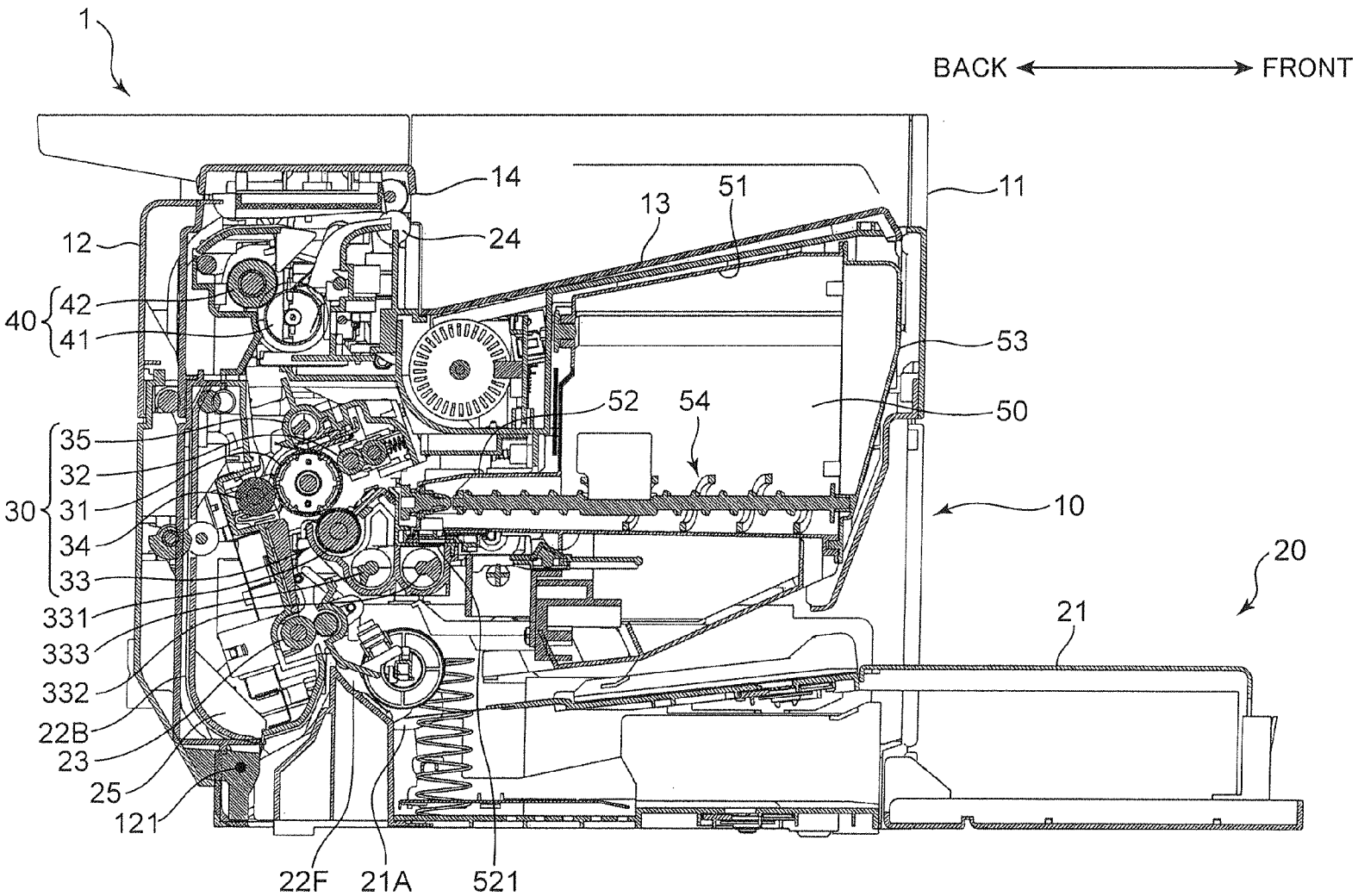
FIG. 1 is a sectional view showing an internal structure of an image forming apparatus according to one embodiment of the present disclosure.

Hereinafter, an embodiment of the present disclosure is described in detail based on the drawings. FIG. 1 is a sectional view showing an internal structure of an image forming apparatus 1 according to one embodiment of the present disclosure. Although a black-and-white printer is illustrated as the image forming apparatus 1 here, the image forming apparatus may be a copier, a facsimile machine, a complex machine provided with these functions or an image forming apparatus for forming a color image.

The image forming apparatus 1 includes a main housing 10 having a substantially rectangular parallelepipedic housing structure and a sheet feeding unit 20, an image forming unit 30, a fixing unit 40 and a toner container 50 (developer storage container) housed in this main housing 10.

A front cover 11 and a rear cover 12 are respectively provided on the front side (right side in FIG. 1) and the rear side of the main housing 10. A user can take the toner container 50 out from the front side of the main housing 10 by opening the front cover 11 when a toner runs out. The rear cover 12 is a cover which is opened in the event of a sheet jam and maintenance. The image forming unit 30 and the fixing unit 40 can be respectively taken out from the rear side of the main housing 10 by opening the rear cover 12. Further, a sheet discharge portion to which a sheet after image formation is discharged is provided on the upper surface of the main housing 10.

The sheet feeding unit 20 includes a sheet cassette 21 for storing sheets on which an image forming process is performed. A part of this sheet cassette 21 projects forward from the front surface of the main housing 10. The sheet cassette 21 includes a sheet storage space in which a stack of the sheets is stored, a lift plate for lifting up the stack of sheets for sheet feeding and the like. A sheet pickup device 21A is provided above a rear end side of the sheet cassette 21. A pickup roller (not shown) for picking up the uppermost sheet of the sheet stack in the sheet cassette 21 one by one is arranged in this sheet pickup unit 21A.

The image forming unit 30 performs the image forming process for forming a toner image to a sheet fed from the sheet feeding unit 20. The image forming unit 30 includes a photoconductive drum 31 (image bearing member), and a charging device 32, an exposure device (not shown in FIG. 1), a developing device 33, a transfer roller 34 and a cleaning device 35 arranged around this photoconductive drum 31.

The photoconductive drum 31 is rotated about its shaft and an electrostatic latent image and a toner image (developer image) are formed on the circumferential surface thereof. A photoconductive drum made of an amorphous silicon (a-Si) material can be used as the photoconductive drum 31. The charging device uniformly charges the surface of the photoconductive drum 31 and includes a charging roller held in contact with the photoconductive drum 31. The exposure device includes optical devices such as a laser light source, a mirror and a lens and irradiates the circumferential surface of the photoconductive drum 31 with light modulated based on image data given from an external apparatus such as a personal computer, thereby forming an electrostatic latent image.

The developing device 33 supplies a toner to the circumferential surface of the photoconductive drum 31 to develop the electrostatic latent image formed on the photoconductive drum 31 and form a toner image. The developing device 33 includes a developing roller 331 for bearing the toner to be supplied to the circumferential surface of the photoconductive drum 31 and a first conveyor screw 332 and a second conveyor screw 333 for conveying a developer in a circulating manner while agitating the developer in the main housing 10 (see FIGS. 2 to 5). This developing device 33 is described in detail later.

The transfer roller 34 is a roller for transferring the toner image formed on the circumferential surface of the photoconductive drum 31 onto a sheet and forms a nip portion together with the photoconductive drum 31. A transfer bias having a polarity opposite to that of the toner is applied to this transfer roller 34. The cleaning device 35 includes a cleaning roller and the like and cleans the circumferential surface of the photoconductive drum 31 after the transfer of the toner image.

The fixing unit 40 performs a fixing process for fixing a transferred toner image onto a sheet. The fixing unit 40 includes a fixing roller 41 internally provided with a heat source and a pressure roller 42 pressed in contact with this fixing roller 41 and forming a nip portion together with the fixing roller 41. When a sheet having a toner image transferred thereto is passed through the fixing nip portion, the toner image is fixed onto the sheet by heating by the fixing roller 41 and pressing by the pressure roller 42.

The toner container 50 stores the toner (developer) to be supplied to the developing device 33. The toner container 50 includes a container main body 51 (container main body) as a main storage part for the toner, a tubular portion 52 projecting from a lower part of one side surface of the container main body 51, a lid member 53 covering the other side surface of the container main body 51, and a rotary member 54 housed in the container for conveying the toner. The toner stored in the toner container 50 is supplied into the developing device 33 through a toner discharge opening 521 provided on the lower surface of the leading end of the tubular portion 52 by driving and rotating the rotary member 54. This toner container 50 is described in detail later with reference to FIG. 6 and subsequent figures.

A main conveyance path 22F and a reversing conveyance path 22B are provided to convey a sheet in the main housing 10. The main conveyance path 22F extends from the sheet pickup device 21A of the sheet feeding unit 20 to a sheet discharge opening 14 provided to face the sheet discharge portion 13 on the upper surface of the main housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

A pair of registration rollers 23 are arranged in a side of the main conveyance path 22F upstream of the transfer nip portion between the photoconductive drum 31 and the transfer roller 34. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B, and a pair of discharge rollers 24 are arranged, for example, near the sheet discharge opening 14.

The reversing conveyance path 22B is formed between the outer side surface of a reversing unit 25 and the inner surface of the rear cover 12 of the main housing 10. Note that the transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the rear conveyance path 22B, the rear cover 12 is opened. If a sheet jam occurs in the main conveyance path 22F or if a unit including the photoconductive drum 31 or the developing device 33 is taken out to the outside, the reversing unit 25 is also opened in addition to the rear cover 12.

Figure 2:
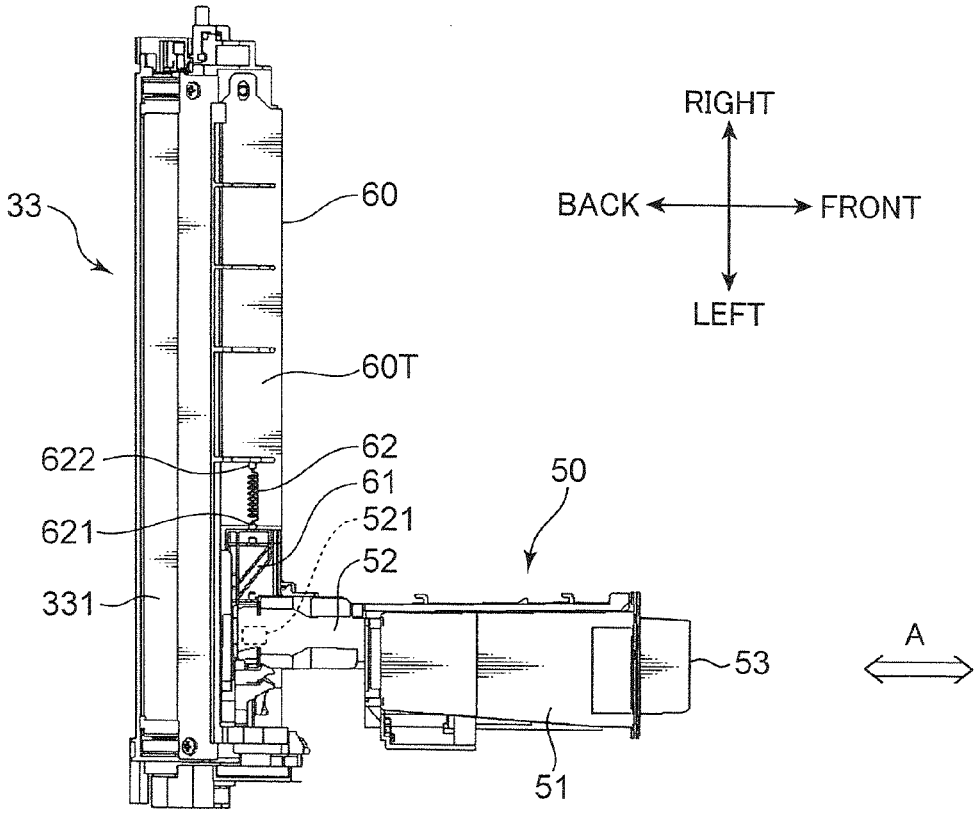
FIG. 2 is a plan view showing a developing device and a toner container incorporated in the image forming apparatus.
Figure 3:
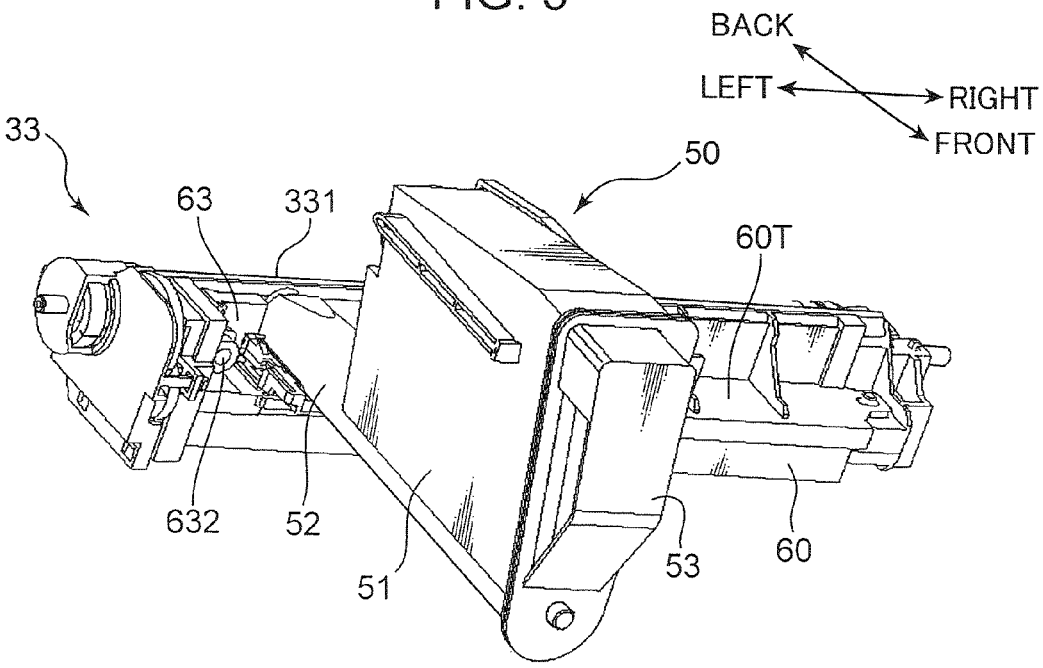
FIG. 3 is a perspective view of the developing device and the toner container shown in FIG. 2.
Figure 4:
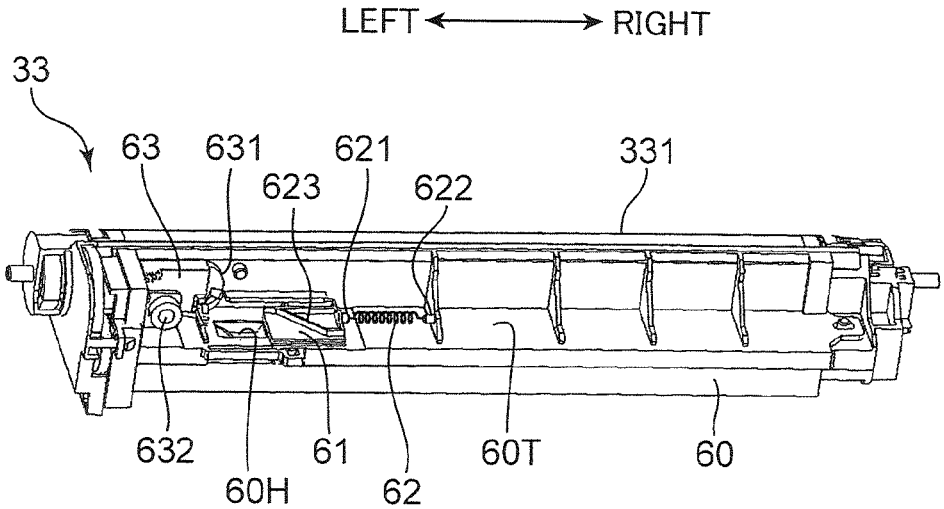
FIG. 4 is a perspective view of the developing device alone.
Figure 5:
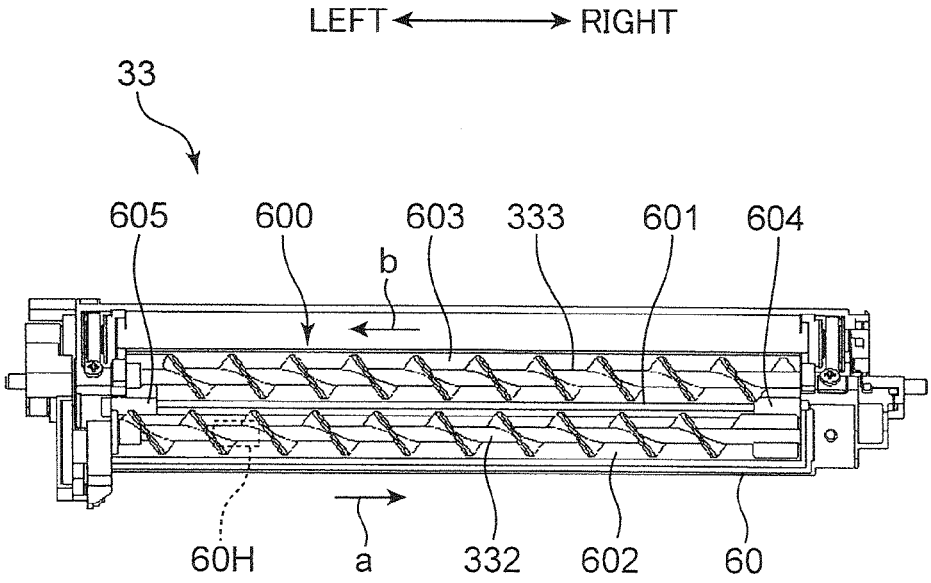
FIG. 5 is a plan view showing an internal structure of the developing device.

Next, the structures and arrangement relationship of the developing device 33 and the toner container 50 are described with reference to FIGS. 2 to 5. FIG. 2 is a plan view and FIG. 3 is a perspective view showing an assembled state of the developing device 33 and the toner container 50, FIG. 4 is a perspective view of the developing device 33 alone, and FIG. 5 is a plan view showing an internal structure of the developing device 33.

The developing device 33 includes the development housing 60 having a box shape long in one direction (axial direction of the developing roller 331). The development housing 60 is formed with an opening extending in a longitudinal direction thereof, and a part of the circumferential surface of the developing roller 331 is exposed through this opening. In this embodiment, the development housing 60 is so assembled into the main housing 10 that the longitudinal direction thereof coincides with a lateral direction of the main housing 10.

A toner supply opening 60H used to receive the toner supplied from the toner container 50 into the development housing 60 is perforated in a ceiling plate 60T near the left end of the development housing 60. The developing device 33 and the toner container 50 are so assembled that this toner supply opening 60H and the toner discharge opening 521 of the toner container 50 vertically overlap. The toner container 50 is attached to and detached from the developing device 33 in directions (forward and backward directions/second direction) perpendicular to the longitudinal direction of the development housing 60 as shown by arrows A in FIG. 2. Since the toner container 50 has a housing shape long in one direction when viewed from above, a substantially L-shaped structure is formed when viewed from above (see FIG. 2) in a state where the toner container 50 is attached to the developing device 33.

A developer shutter plate 61 slidable in the lateral direction is arranged on the upper surface of the ceiling plate 60T. The developer shutter plate 61 is constantly biased leftward by a biasing spring 62. The biasing spring 62 is a coil spring and end parts thereof are attached to engaging portions 621, 622 respectively provided on the right end edge of the developer shutter plate 61 and a rib adjacent to the developer shutter plate 61. Although the toner supply opening 60H in an open state is shown in FIG. 4, the developer shutter plate 61 is located on the left side by being biased by the biasing spring 62 and closes the toner supply opening 60H in a state where the toner container 50 is not attached.

A pressing plate 522 is mounted on a lower part of the leading end edge (other end portion 524) of the tubular portion 52 of the toner container 50. Further, a container gear 54G for inputting a rotational drive force to the rotary member 54 is arranged and exposed on the leading end surface of the tubular portion 52 (see FIG. 6). A gear holder 63 including an input gear 631 and a coupling 632 is arranged at a left back side of the toner supply opening 60H of the development housing 60. A rotational drive force from an unillustrated motor provided in the main housing 10 is applied to the coupling 632. The input gear 631 is engaged with the container gear 54G with the toner container 50 attached to the developing device 33 and transmits the rotational drive force to the container gear 54G.

In attaching the toner container 50 to the developing device 33, the tubular portion 52 of the toner container 50 is inserted backward into the toner supply opening 60H from the front side. At this time, the pressing plate 522 of the toner container interferes with the developer shutter plate 61 closing the toner supply opening 60H and moves the developer shutter plate 61 rightward. Specifically, an oblique elongated projection 623 projecting on the upper surface of the developer shutter plate 61 and the pressing plate 522 interfere and the developer shutter plate 61 is pushed rightward against a biasing force of the biasing spring 62. When the tubular portion 52 of the toner container 50 is inserted to a predetermined position, the toner supply opening 60H is completely opened and the container gear 54G is engaged with the input gear 631.

With reference to FIG. 5, the development housing 60 includes an internal space 600. In the case of two-component development method, a developer composed of a toner and a carrier is filled in this internal space 600. The carrier is agitated and mixed with the toner in the internal space 600 to charge the toner and conveys the toner to the developing roller 331. The toner is successively supplied to the developing roller 331 to be consumed and a consumed amount of the toner is appropriately supplied from the toner container 50.

The internal space 600 of the development housing 60 is partitioned into a first passage 602 and a second passage 603 long in the lateral direction by a partition plate 601 extending in the lateral direction. The partition plate 601 is shorter than the width of the development housing 60 in the lateral direction, and a first communicating portion 604 and a second communicating portion 605 are provided on the right and left ends of the partition plate 601 to allow communication between the first and second passages 602, 603. In this way, a circulation path composed of the first passage 602, the first communicating portion 604, the second passage 603 and the second communicating portion 605 is formed in this development housing 60.

The toner supply opening 60H described above is arranged above the vicinity of the left end of the first passage 602. The first conveyor screw 332 is housed in the first passage 602 and the second conveyor screw 333 is housed in the second passage 603. Each of the first and second conveyor screws 332, 333 includes a shaft and a blade member spirally projecting on the outer periphery of this shaft. The first conveyor screw 332 is driven and rotated about the shaft to convey the developer in a direction of an arrow "a" of FIG. 5. On the other hand, the second conveyor screw 333 is driven and rotated about the shaft to convey the developer in a direction of an arrow "b".

By driving and rotating the first and second conveyor screws 332, 333, the developer is conveyed in a circulating manner along the above circulation path. The toner supplied through the toner supply opening 60H anew is described. This toner drops into the first passage 602, mixed with the existing developer and conveyed in the direction of the arrow "a" by the first conveyor screw 332. At this time, the toner is agitated with the carrier to be charged. Subsequently, the toner enters the second passage 603 through the first communicating portion 604 from the downstream end of the first passage 602, and is conveyed in the direction of the arrow "b" by the second conveyor screw 333. During this conveyance, the toner is partly supplied to the circumferential surface of the developing roller 331 while being similarly charged. The remaining toner and the carrier are returned to the upstream end of the first passage 602 through the second communicating portion 605.

Figure 6:
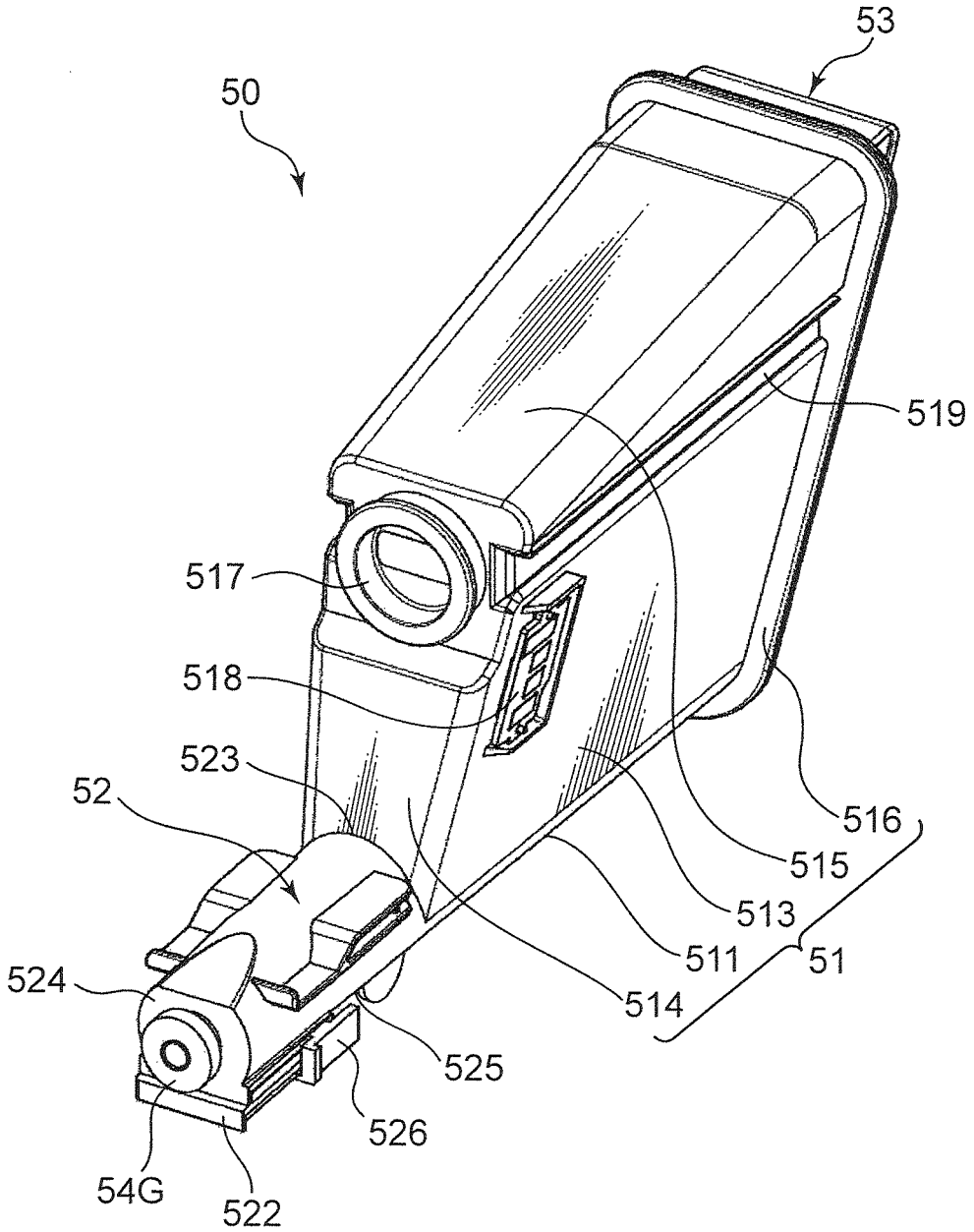
FIG. 6 is a perspective view of the toner container.
Figure 7:
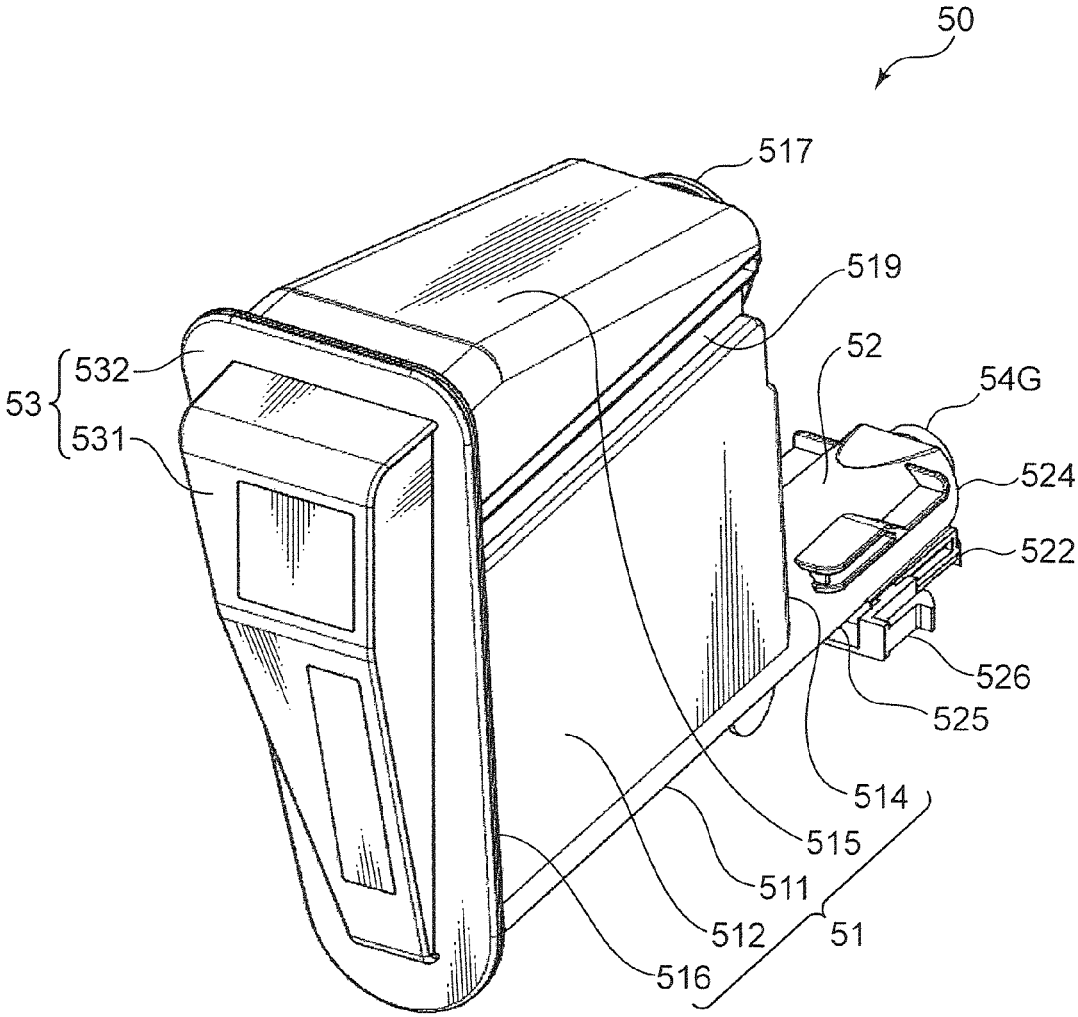
FIG. 7 is a perspective view of the toner container viewed in a direction 180° different from that in FIG. 6.
Figure 8:
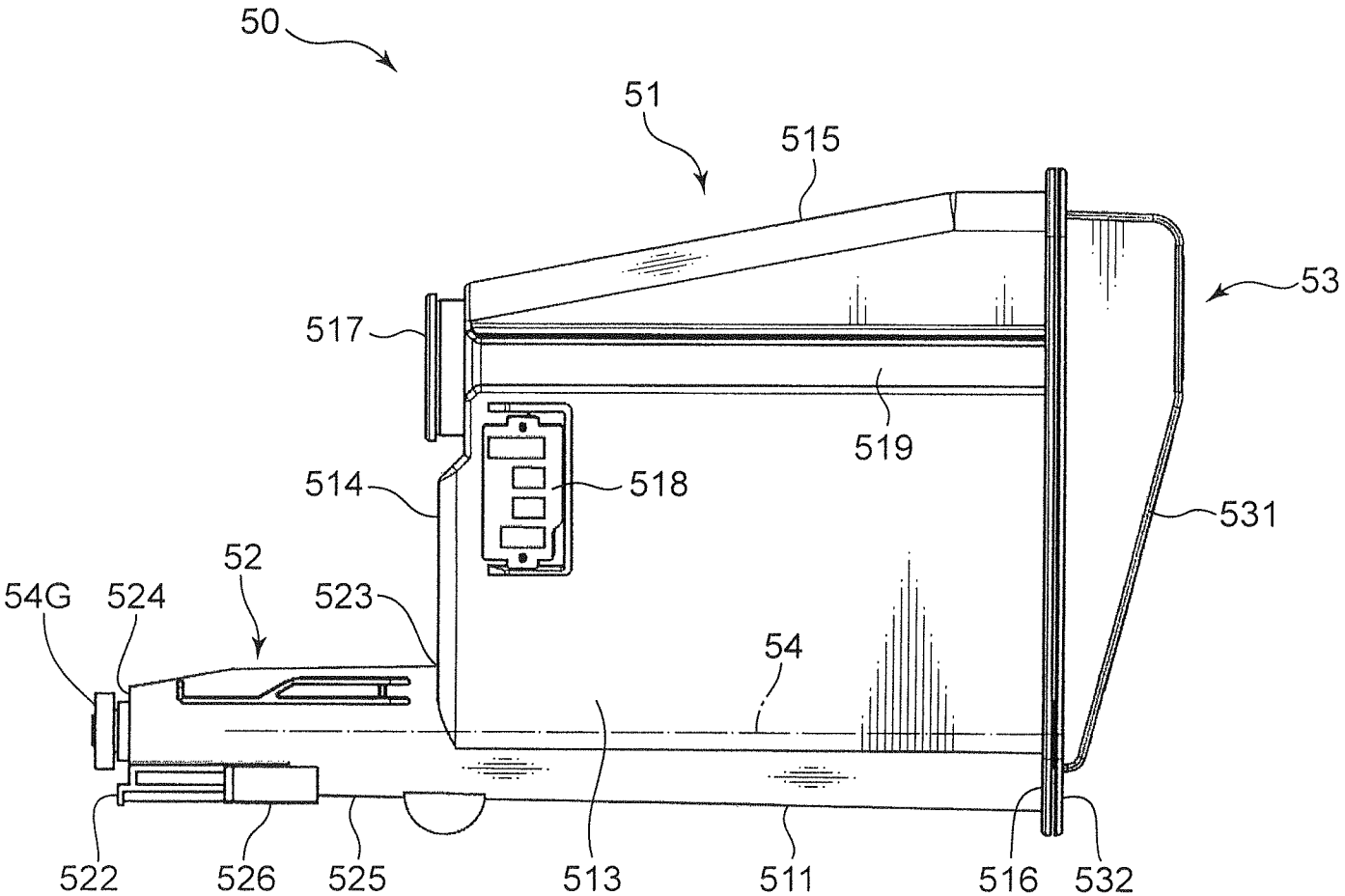
FIG. 8 is a side view of the toner container.
Figure 9:
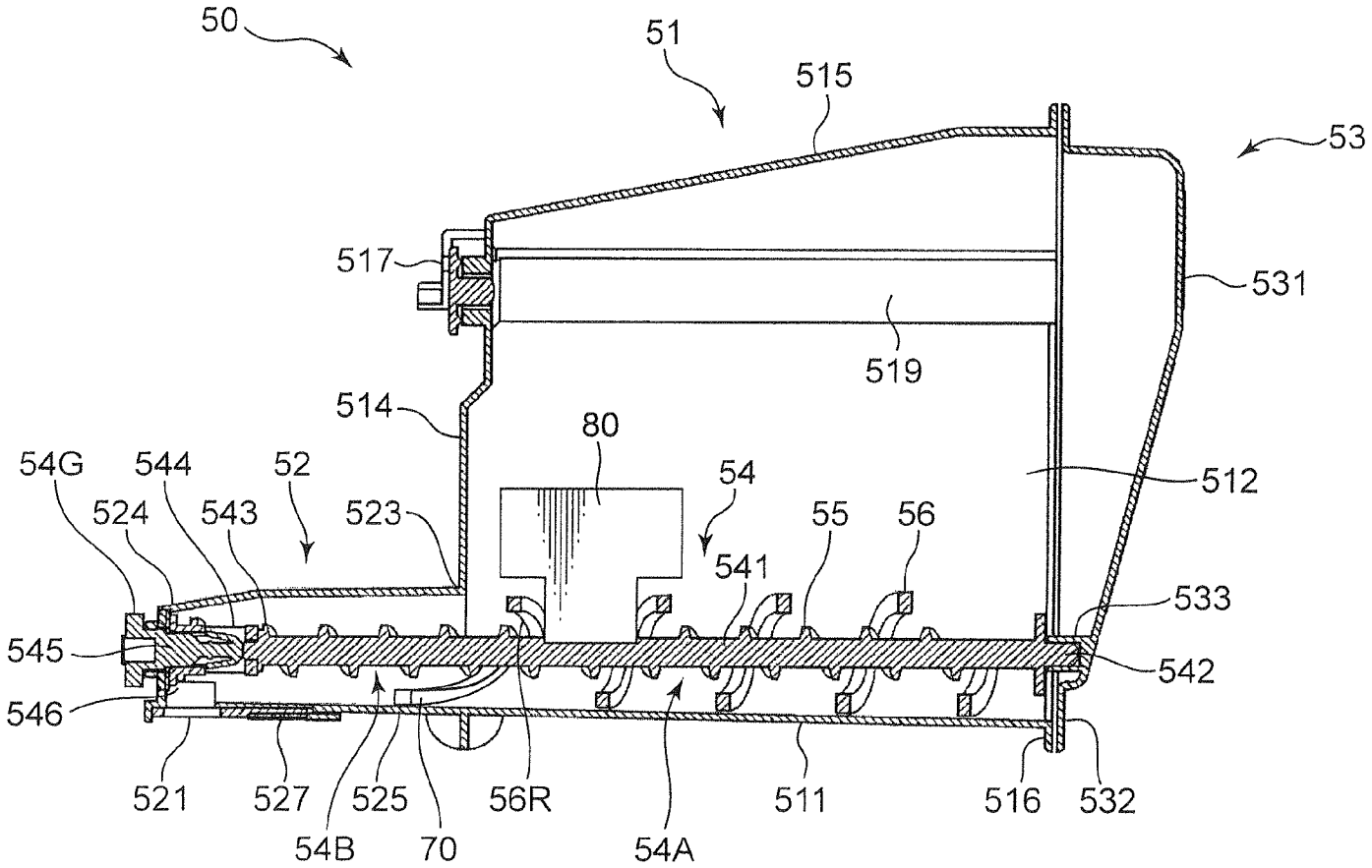
FIG. 9 is a side view in section of the toner container.
Figure 10:
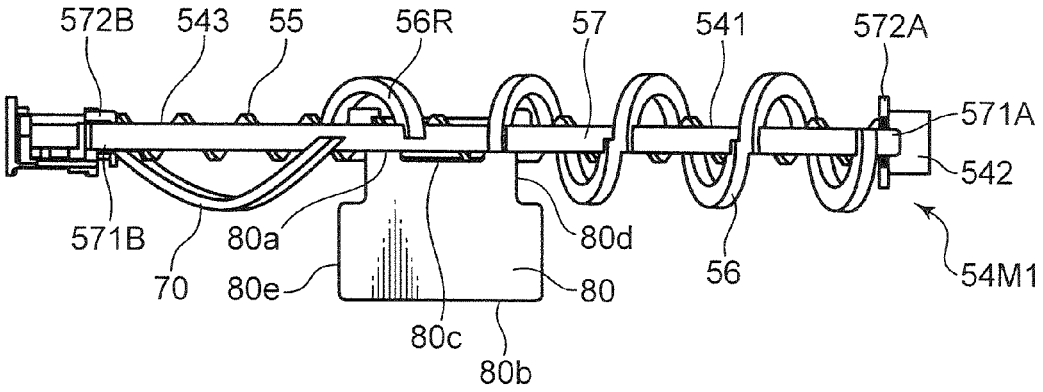
FIG. 10 is a plan view of a rotary member arranged in the toner container.
Figure 11:
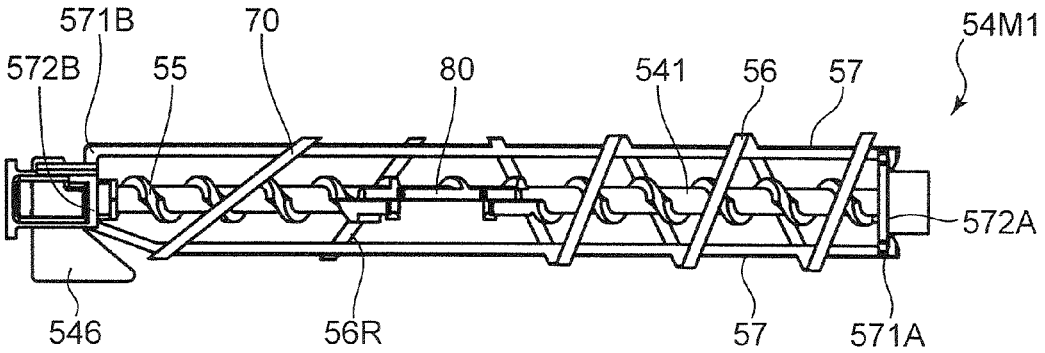
FIG. 11 is a front view of the rotary member arranged in the toner container.
Figure 12:
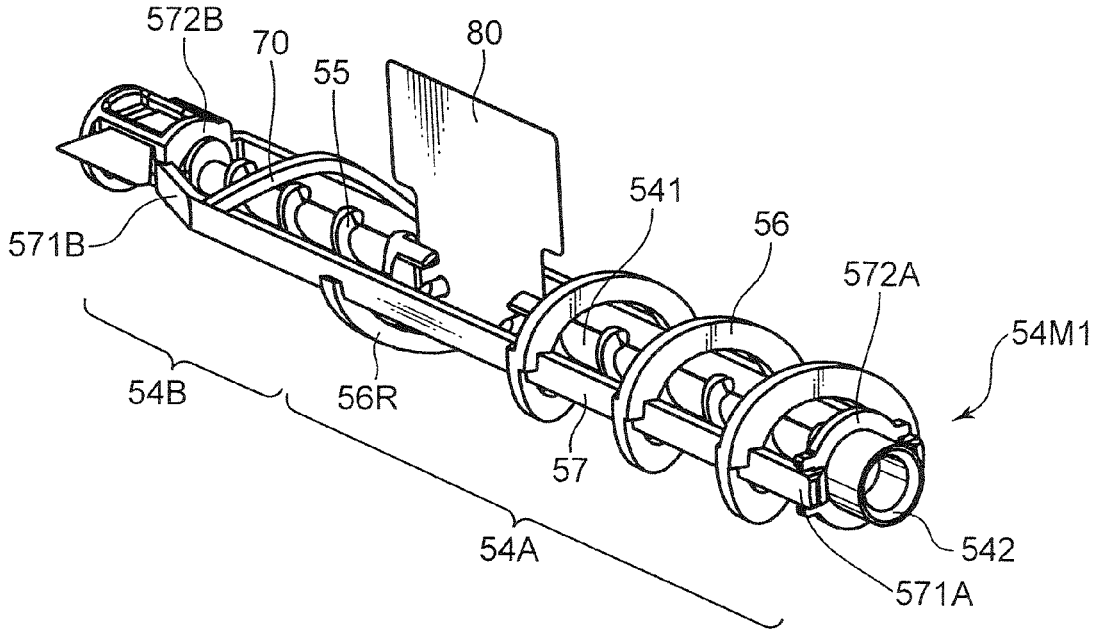
FIG. 12 is a perspective view of the rotary member arranged in the toner container.

Next, the detailed structure of the toner container 50 is described with reference to FIGS. 6 to 12. FIG. 6 is a perspective view of the toner container 50 viewed from the tubular portion 52 side (rear side in FIG. 1), FIG. 7 is a perspective view viewed from the lid member 53 side by changing a viewing direction by 180°, FIG. 8 is a side view and FIG. 9 is a side view in section of the toner container 50, and FIGS. 10 to 12 are respectively a plan view, a front view and a perspective view of the rotary member 54 arranged in the toner container 50.

As already described, the toner container 50 includes the container main body 51, the tubular portion 52, the lid member and the rotary member 54. To form a space for storing the toner, the container main body 51 includes a bottom wall 511 extending in one direction and having a semicircular cross-section, a first side wall 512 extending upward from one end edge of the bottom wall 511, a second side wall 513 extending upward from the other end edge of the bottom wall 511 and facing the first side wall 512, a third side wall 514 connecting the first and second side walls 512, 513 on an end edge part of the tubular portion 52 side, a ceiling wall 515 connecting the upper end edges of the first and second side walls 512, 513, and a first flange portion 516 formed on an end edge at a side facing the lid member 53. Note that the first flange portion 516 side of the container main body 51 is a laterally open surface.

The container main body 51 has such a vertically long external shape that a part with the bottom wall 511 is narrowest and a spacing between the first and second side walls 512, 513 is gradually widened from the bottom wall 511 toward an upper side. The first and second side walls 512, 513 are plate-like members and have a straight inner surface in a cross-section. The bottom wall 511 has a semicircular inner wall surface corresponding to a rotation path of a most radially projecting part of a second conveying member 56 of the rotary member 54 to be described later.

A cap 517 for closing an opening used to fill the toner into the container main body 51 is mounted on an upper part of the third side wall 514. A wireless tag 518 recorded with management information of this toner container 50 is attached to the second side wall 513. Further, a pair of groove portions 519 parallel to an extending direction of the bottom wall 511 are formed on the first and second side walls 512, 513 near upper end parts. These groove portions 519 are parts to be guided by unillustrated guide members of the main housing 10 in mounting the toner container 50 into the main housing 10.

The tubular portion 52 is a cylindrical part projecting from the third side wall 514 and connected to the bottom wall 511. One end portion 523 of the tubular portion 52 is connected to a lower end part of the third side wall 514 and an internal space of the container main body 51 and that of the tubular portion 52 communicate. Another end portion 524 of the tubular portion 52 is the projecting end of the tubular portion 52, and the container gear 54G is arranged to project further outward from the other end portion 524. A bottom portion 525 of the tubular portion 52 is flush with the bottom wall 511 of the container main body 51, whereby a gutter-like part having a semicircular cross-section is formed from the first flange portion 516 to the other end portion 524. The tubular portion 52 has an inner wall surface having a circular cross-sectional shape along a radial direction of a rotary shaft 541 and is slightly tapered from the one end portion 523 toward the other end portion 524.

As described above, the tubular portion 52 includes the toner discharge opening 521 (developer discharge opening) and is attached to the developing device 33. Note that the toner discharge opening 521 is a drop opening arranged on the bottom portion 525 (lower surface) of the tubular portion 52. An engaging portion 526 to be engaged with a part of the development housing 60 when the toner container 50 is attached is arranged on the bottom portion 525. The toner stored in the container main body 51 is fed to the tubular portion 52 and discharged through the toner discharge opening 521 by driving and rotating the rotary member 54 to be described later.

As shown in FIG. 9, the toner discharge opening 521 is provided at a position of the bottom portion 525 near the other end portion 524. A shutter plate 527 which slides along an extending direction of the tubular portion 52 is attached to the lower surface of the toner discharge opening 521. The shutter plate 527 is biased in a direction toward the other end portion 524 by an unillustrated biasing member to constantly close the toner discharge opening 521. On the other hand, in attaching the tubular portion 52 to the developing device 33, the shutter plate 527 interferes with a part of the development housing 60 and slides in a direction toward the one end portion 523. FIG. 9 shows a state where the shutter plate 527 moves backward to open the toner discharge opening 521. Note that the shutter plate 527 and the above engaging portion 526 are an integral member.

The lid member 53 is for covering the laterally open surface of the container main body 51 and includes a lid main body 531 having a concave shape and a second flange portion 532 provided on the peripheral edge of the lid main body 531 and to be butted against the first flange portion 516. The lid main body 531 has an inclined surface inclined outward from bottom to top and a vertical surface connected to the upper end of this inclined surface. The vertical surface of the lid main body 531 is a part considerably projecting from the second flange portion 532 and the user can mount and detach the toner container 50 into and from the main housing 10 by gripping this part. A shaft supporting portion 533 for rotatably supporting a first end portion 542 of the rotary shaft of the rotary member 54 to be described later is provided at the lower end of the inner surface of the lid main body 531. The second flange portion 532 is welded to the first flange portion 516 with the first end portion 542 inserted in the shaft supporting portion 533.

<Structure of Rotary Member>

The rotary member 54 (54M1) is a member which is arranged above the bottom wall 511 of the container main body 51 (container main body) and also in the tubular portion 52 and conveys the toner by being driven about the axis. As shown in FIGS. 9 to 12, the rotary member 54 (54M1) includes the rotary shaft 541, a film member 546 which rotates together with the rotary shaft 541, a first conveying member 55, a second conveying member 56 and a pair of dispersing members 57. Further, the rotary member 54 includes a spiral piece 56R which rotates together with the rotary shaft 541, a rectifying spiral 70 and an agitating film 80 (flexible member).

The rotary shaft 541 is arranged to extend in the extending direction of the bottom wall 511 and includes the first end portion 542 and a second end portion 543 on both ends thereof. The first end portion 542 is rotatably supported by the shaft supporting portion 533 of the lid member 53. A tubular holding piece 544 is integrally mounted on the second end portion 543. The container gear 54G and the rotary shaft 541 are united by fitting a trunk portion 545 of the container gear 54G into this tubular holding piece 544. The trunk portion 545 is rotatably supported at the other end portion 524 of the tubular portion 52. The rotary shaft 541 extends from the container main body 51 to the tubular portion 52 and includes a first section 54A arranged in the container main body 51 and a second section 54B arranged in the tubular portion 52.

The film member 546 is arranged on the tubular holding piece 544 and functions to feed the toner to the toner discharge opening 521. The film member 546 is a rectangular, thin and flexible PET film, projects in a direction perpendicular to an axial direction of the rotary shaft 541 and is attached to the circumferential surface of the tubular holding piece 544. The film member 546 turns when the rotary shaft 541 rotates, thereby causing the toner present near the other end portion 524 of the tubular portion 52 to flow and feeding the toner to the toner discharge opening 521.

The first conveying member 55 is a conveying member integral to the rotary shaft 541 and projecting in a spiral manner on the circumferential surface of the rotary shaft 541. The first conveying member 55 is formed substantially over the entire axial length of the rotary shaft 541. That is, the first conveying member 55 is formed on the circumferential surface of a part equivalent to both the first section 54A and the second section 54B of the rotary shaft 541.

The second conveying member 56 is a hollow spiral conveying member arranged around the rotary shaft 541 with gaps formed between the second conveying member 56 and the rotary shaft 541, the first conveying member 55. That is, the second conveying member 56 is arranged at a side radially outward of the first conveying member 55. The second conveying member 56 is arranged only in an area corresponding to the first section 54A.

The pair of dispersing members 57 are rod-like members having substantially the same length as the rotary shaft 541 and arranged in parallel to the rotary shaft 541 and connect respective lateral parts of the second conveying member 56. One and the other dispersing members 57 are arranged at an interval of 180° in a circumferential direction of the rotary shaft 541. The pair of dispersing members 57 are connected to each other at end portions 571A thereof by a connecting piece 572A. A central part of the connecting piece 572A is fixed to the vicinity of the first end portion 542 of the rotary shaft 541. End portions 571B of the pair of dispersing members 57 are connected by a similar connecting piece 572B also at the second end portion 543 side. Specifically, the rotary shaft 541, the second conveying member 56 and the dispersing members 57 are united by the connecting pieces 572A, 572B, so that the second conveying member 56 and the dispersing members 57 integrally rotate when the rotary shaft 541 rotates. The dispersing members 57 are arranged over both the first and second sections 54A, 54B (FIGS. 10 to 12).

The configurations of the first conveying member 55, the second conveying member 56 and the pair dispersing members 57 are, in other words, as follows. The second conveying member 56 is composed of a plurality of semicircular arched conveying pieces, which are united by the pair of dispersing members 57. As a result, the spiral second conveying member 56 including a hollow part near an axial center is formed. An inner diameter of the hollow part of the second conveying member 56 is larger than a spiral outer diameter of the first conveying member 55. In the configuration of the rotary member 54 of this embodiment, the rotary shaft 541 including the first conveying member 55 on the circumferential surface is concentrically inserted in the hollow part. Note that a spiral direction of the first conveying member 55 and that of the second conveying member 56 are opposite.

The spiral piece 56R is a semicircular arched conveying piece extending between the pair of dispersing members 57. The spiral piece 56R is arranged at a predetermined distance from the second conveying member 56 toward the second end portion 543. This spiral piece 56R has substantially the same size as the arched conveying pieces of the second conveying member 56. However, the spiral piece 56R is so arranged that a spiral direction thereof is opposite to that of the arched conveying pieces of the second conveying member 56. The spiral piece 56R is arranged near a boundary between the first section 54A and the second section 54B and at a predetermined distance from an end part of the second conveying member 56 in the axial direction of the rotary shaft 541. The spiral piece 56R rotates together with the dispersing members 57 as the rotary shaft 541 rotates.

The rectifying spiral 70 is arranged closer to the second end portion 543 than the spiral piece 56R and composed of a semi-elliptical arched conveying piece. The arched conveying piece of the rectifying spiral 70 has substantially the same outer and inner diameters as the arched conveying pieces of the second conveying member 56 and is shaped as if the arched conveying piece of the second conveying member 56 were stretched in the axial direction of the rotary shaft 541 to have a pitch which is about twice as large. The rectifying spiral 70 is arranged over half the circumference in a rotating direction, i.e. over a range corresponding to a half pitch. Since the rectifying spiral 70 is fixed to the pair of dispersing members 57, it integrally rotates when the rotary shaft 541 rotates. The rectifying spiral 70 is connected to an end part of the spiral piece 56R in the axial direction of the rotary shaft 541 and arranged from the vicinity of the boundary between the first and second sections 54A, 54B to the second end portion 543 of the rotary shaft 541.

The agitating film 80 functions to agitate the toner in the container main body 51. The agitating film 80 is arranged between the second conveying member 56 and the spiral piece 56R in the axial direction of the rotary shaft 541. In other words, the agitating film 80 is arranged in the vicinity of a downstream end of the first section 54A of the rotary shaft 541 in a second conveying direction to be described later. As shown in FIGS. 10 to 12, the agitating film 80 is a thin and flexible PPS (polyphenylene sulfide) resin film having a T shape in a plan view. The agitating film 80 extends from the circumferential surface of the rotary shaft 541 in a direction perpendicular to the axial direction of the rotary shaft 541 and includes a fixed end portion 80*a* fixed to the circumferential surface of the rotary shaft 541 and a free end portion 80*b* arranged at a side radially outward of the second conveying member 56.

The T shape of the agitating film 80 is composed of a relatively narrow base end portion 80*d* radially extending from the fixed end portion 80*a* and a leading end portion 80*e* extending further radially outward from this base end portion 80*d* and wider than the base end portion 80*d*. The leading end portion 80*e* is located radially outward of a part of the second conveying member 56 having a maximum outer diameter. Accordingly, the length of the free end portion 80*b* in the axial direction of the rotary shaft 541 is set to be longer than that of the fixed end portion 80*a* in the axial direction of the rotary shaft 541. Further, a long hole portion 80*c* is arranged at the base of the fixed end portion 80*a*. The long hole portion 80*c* is engaged with a holding piece 541*a* (FIG. 13B) arranged on the rotary shaft 541. By this engagement, the agitating film 80 is driven and rotated together with the rotary shaft 541.

<Toner Conveying Directions of Respective Members>

When a rotational drive force for rotating the rotary shaft 541 in a predetermined rotating direction is applied to the container gear 54G, each of the first and second conveying members 55, 56 generates a toner conveying force according to the spiral direction thereof. The second conveying member 56 conveys the toner in a direction from the container main body 51 toward the tubular portion 52 (the toner discharge opening 521) (hereinafter, second conveying direction). That is, the second conveying member 56 conveys the toner from the first end portion 542 of the rotary shaft 541 toward the second end portion 543. On the contrary, the first conveying member 55 conveys the toner in a returning direction from the tubular portion 52 toward the container main body 51 (hereinafter, first conveying direction). That is, the first conveying member 55 conveys the toner from the second end portion 543 of the rotary shaft 541 toward the first end portion 542.

On the other hand, the dispersing members 57 function to disperse the toner being conveyed by the first and second conveying members 55, 56 radially outward of the rotary shaft 541. That is, the dispersing members 57 disperse the toner present around the toner, to which a thrust force is applied by the spiral pieces of the first or second conveying member 55 or 56, radially outward. This promotes the movement of the toner in the first or second conveying direction.

The spiral piece 56R conveys the toner in the first conveying direction since being arranged in a direction opposite to the spiral direction of the second conveying member 56. The spiral piece 56R generates a conveying force to actively return the toner from the tubular portion 52 to the container main body 51 near the boundary between the container main body 51 and the tubular portion 52.

The rectifying spiral 70 conveys the toner in the second conveying direction since having a spiral shape in the same direction as the spiral direction of the second conveying member 56. The rectifying spiral 70 auxiliarily applies a conveying force to move the toner in the tubular portion 52 toward the toner discharge opening 521. Further, the rectifying spiral 70 functions to rectify the flow of the toner into the toner discharge opening 521 when the remaining amount of the toner in the container main body 51 decreases and the fluidity of the toner suddenly increases.

<Description on Operation of Rotary Member>

Figure 13B:
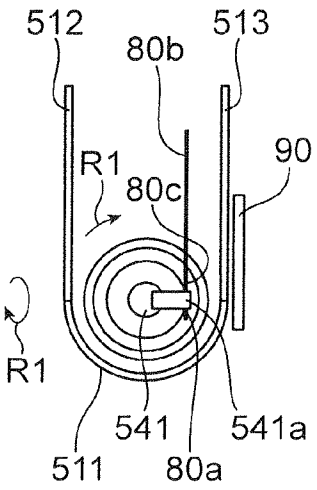
FIG. 13A is a schematic side view in section and FIG. 13B is a sectional view of a toner container showing a toner conveying operation by a rotary member.
Figure 13A:
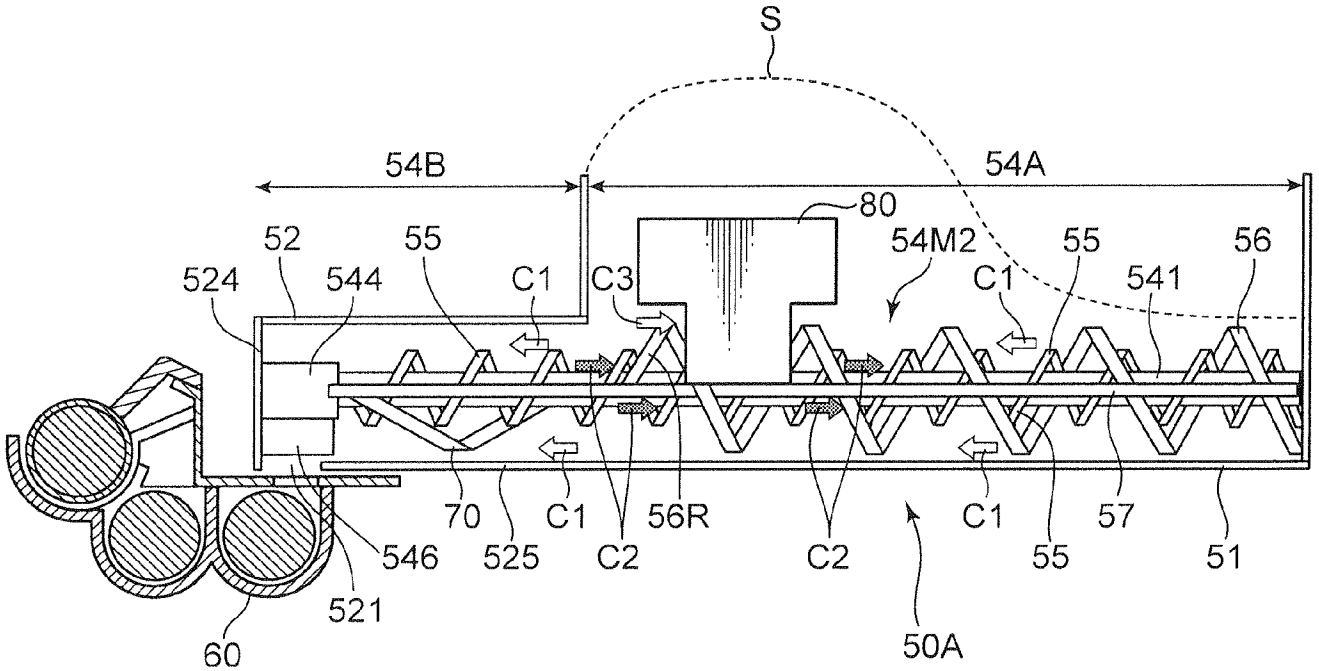
Figure 14B:
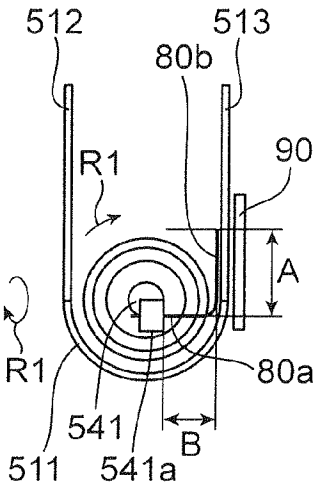
FIG. 14A is a schematic side view in section and FIG. 14B is a sectional view of the toner container in a state where the rotary member is rotated 90° from a state of FIG. 13A.
Figure 14A:
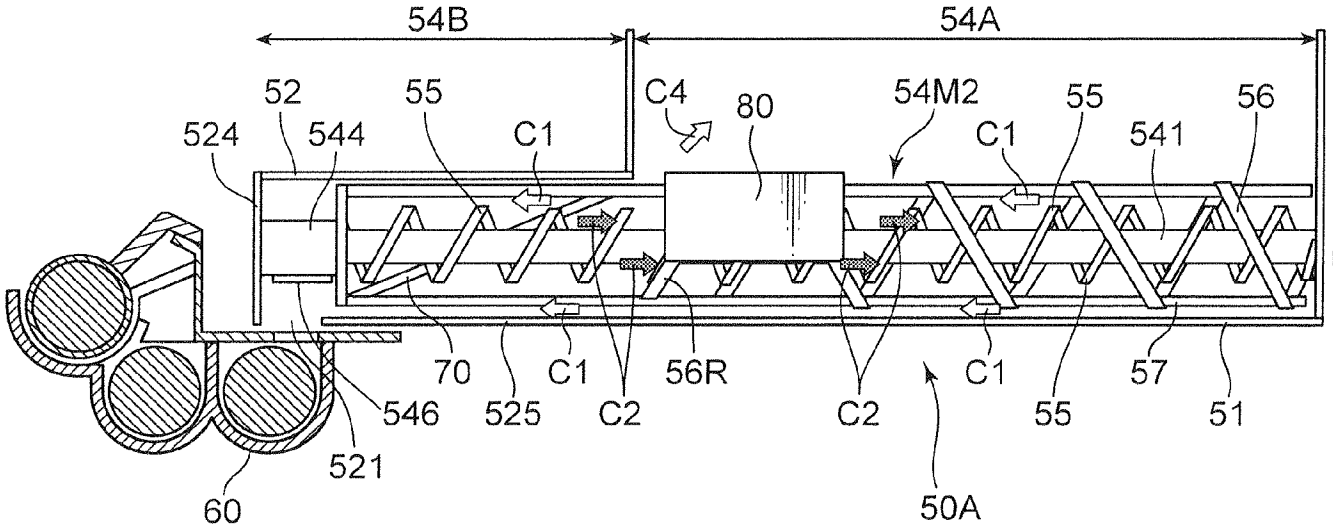

As described above, the rotary member 54 of this embodiment has an ability to convey the toner in mutually different directions at the radially inner side (first conveying member 55) and the radially outer side (second conveying member 56). Next, a toner conveying operation by this rotary member 54 (54M2) is described based on FIGS. 13A to 14B. FIG. 13A and FIG. 13B are a schematic side view in section and a sectional view of a toner container 50A showing a toner conveying operation of the rotary member 54M2. FIG. 14A and FIG. 14B are a schematic side view in section and a sectional view of the toner container 50A in a state where the rotary member 54M2 is rotated 90° from a state of FIG. 13A.

Note that the rotary member 54M1 shown in FIGS. 10 to 12 and the rotary member 54M2 shown in FIGS. 13A to 14B differ in the arrangement of the agitating film 80 on the rotary shaft 541 in the circumferential direction. An operation in the case of selecting the arrangement of the agitating film 80 shown in FIGS. 10 to 12 is described in an embodiment described later. Further, a direction of inclination (winding direction of a spiral shape) of each member having a spiral shape is opposite between the rotary member 54M1 shown in FIGS. 10 to 12 and the rotary member 54M2 shown in FIGS. 13A to 14B. In this way, the direction of inclination of each spiral shape may be opposite (reversely wound) if a relative inclination relationship of the respective members is maintained. In this case, the rotary member 54M1 (FIGS. 10 to 12) and the rotary member 54M2 (FIGS. 13A to 14B) can fulfill similar effects of the respective members by being rotated in mutually opposite directions about the rotary shaft 541.

With reference to FIG. 13A, the second conveying member applies a pushing force to move the toner in the second conveying direction by being driven and rotated. The toner being moved toward the tubular portion 52 by the second conveying member 56 exclusively moves near the outer peripheral part of the rotary member as shown by arrows C1 in FIG. 13A. In this embodiment, the second conveying member 56 is not present in the tubular portion 52. However, since the dispersing members 57 present substantially on the same circumferential path as the second conveying member 56 in the radial direction of the rotary shaft 541 causes the toner near the inner peripheral wall of the tubular portion 52 to flow, a thrust force of the toner in the second conveying direction is maintained. Further, the rectifying spiral 70 arranged on the dispersing members 57 in the tubular portion 52 assists the movement of the toner in the second conveying direction. Thus, the toner moves toward the other end portion 524 as shown by the arrows C1 in a part near the inner peripheral wall also in the tubular portion 52.

The toner conveyed in the second conveying direction eventually reaches the other end portion 524 of the tubular portion 52. A part of the toner that has reached drops into the development housing 60 through the toner discharge opening 521 by being pushed by the film member 546.

On the other hand, the toner that has not been discharged through the toner discharge opening 521 is exclusively conveyed in the reverse direction, i.e. in the first conveying direction in a part near the center axis of the tubular portion 52 as shown by arrows C2 in FIG. 13A by driving the first conveying member 55. The toner that is conveyed in the reverse direction eventually passes the boundary between the tubular portion 52 and the container main body 51 and is returned to the container main body 51, coupled with a dispersion effect by the dispersing members 57.

At this time, the spiral piece 56R further promotes the above reversely conveying function. In the tubular portion 52, the range of the toner moving radially outward of the rotary shaft 541 is limited and such a movement range of the toner is relatively small also near the boundary between the tubular portion 52 and the container main body 51. Near such a boundary, a pushing force in a direction of an arrow C3 of FIG. 13A to feed the toner from the tubular portion 52 to the container main body 51 can be generated by rotating the spiral piece 56R. The toner that has been pushed back in the direction of the arrow C3 is dispersed radially outward of the rotary shaft 541 as shown by an arrow C4 of FIG. 14A by driving and rotating the dispersing members 57. Accordingly, collision of the toner conveyed in the forward direction, i.e. in the second conveying direction by the second conveying member 56 and the toner conveyed in the reverse direction, i.e. in the first conveying direction by the first conveying member 55 is alleviated and the toner can be smoothly returned from the tubular portion 52 to the container main body 51.

As just described, the toner container 50 of this embodiment has a circulatingly conveying function of returning the toner, which has been fed to the tubular portion 52 by the second conveying member 56, to the container main body 51 by the first conveying member 55. Thus, even in the toner container 50 structured such that the toner discharge opening 521 is provided at the leading end of the tubular portion 52, it can be suppressed that the toner is condensed near the toner discharge opening 521.

Specifically, the tubular portion 52 is a part including a narrow tubular inner space having an inner diameter somewhat larger than the spiral outer diameter of the second conveying member 56. When the rotary member 54 only has a function of conveying the toner in the second conveying direction in the toner container 50 including such a tubular portion 52, the toner eventually has nowhere to go and is packed in the tubular portion 52 and finally condensed if a toner discharge amount is less than a toner feed amount. This causes a problem that the toner discharge opening 521 is clogged with the condensed mass of the toner and the toner cannot be discharged.

Contrary to this, since the first conveying member 55 is arranged in the tubular portion 52 and has a function of conveying the toner in the reverse direction, i.e. in the first conveying direction in the toner container 50 of this embodiment, the toner is not packed. Specifically, since being unable to move radially outward in the tubular portion 52, the toner tries to move in the axial center direction of the tubular portion 52. The first conveying member 55 is arranged in an axial central part to convey the toner in the first conveying direction. Thus, the toner can be efficiently returned from the tubular portion 52 to the container main body 51 before being condensed.

<Concerning Agitating Film>

Figure 17B:
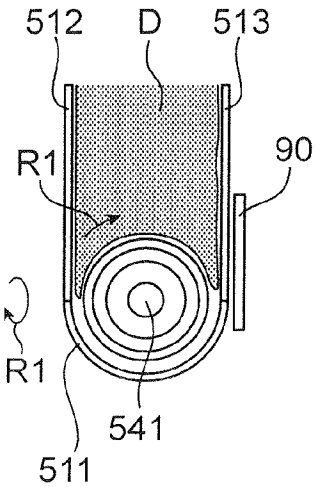
FIG. 17A is a schematic side view in section and FIG. 17B is a sectional view showing a state of tunnel-like condensation which occurs in the toner container.
Figure 17A:
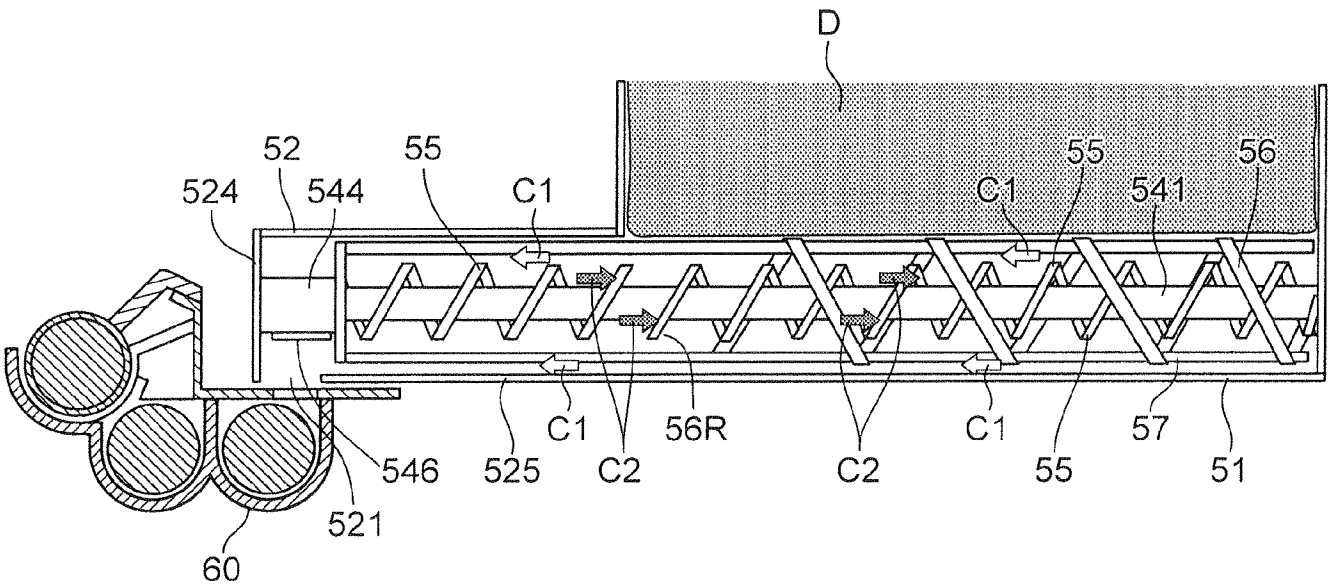

As described above, in this embodiment, the rotary member 54M2 includes the first and second conveying members 55, 56. This causes the toner to smoothly move in the axial direction inside and outside a cylindrical shape formed by the rotation of the second conveying member 56. On the other hand, if the fluidity of the toner is poor such as due to an installation environment of the toner container 50, the toner stored in the toner container 50 may be condensed in a tunnel-like manner outside the cylindrical shape unlikely to be affected by a rotational force of the second conveying member 56 (area D in FIGS. 17A and 17B). Even in such a case, the agitating film 80 (flexible member) arranged on the rotary shaft 541 can agitate the toner arranged outside the cylindrical shape in this embodiment.

As shown in FIG. 13B, the agitating film 80 is rotated in a direction of an arrow R1 together with the rotary shaft 541 in the container main body 51. Specifically, the long hole portion 80*c* (see FIG. 10) provided on the fixed end portion 80*a* is engaged with the holding piece 541*a* projecting toward the second side wall 513 from the rotary shaft 541 in a state where the free end portion 80*b* is facing vertically upward. By this engagement, the rotary shaft 541 and the agitating film 80 are integrally rotated. When the rotary shaft 541 rotates 90° in the direction of the arrow R1 until a state of FIG. 14B is reached from a state of FIG. 13B, the free end portion 80*b* arranged outside the second conveying member 56 comes into contact with the inner surface of the second side wall 513 while being deflected toward an upstream side in the rotating direction (direction opposite to the arrow R1).

As the rotary shaft 541 further rotates, the free end portion 80*b* of the agitating film 80 moves the toner near the inner surfaces in the direction of the arrow R1 while coming into contact successively with the inner surfaces of the second side wall 513, the bottom wall 511 and the first side wall 512. Further, since the agitating film 80 is made of the flexible PET film, an elastic force of the free end portion 80*b* is released and acts to flip the toner around the free end portion 80*b* when the free end portion 80*b* moves away from the inner surface of the first side wall 512. This can promote the fluidity of the surrounding toner. Here, in the agitating film 80, a length of the free end portion 80*b* in the axial direction of the rotary shaft 541 is set to be longer than that of the fixed end portion 80*a* in the axial direction of the rotary shaft 541. Thus, the free end portion 80*b* of the agitating film 80 can agitate the toner in wider range in the container main body 51.

Further, the agitating film 80 is arranged near the downstream end part of the first section 54A in the second conveying direction, i.e. near the boundary between the first and second sections 54A, 54B in the axial direction of the rotary shaft 541. Thus, the toner moved from the first section 54A toward the second section 54B by the second conveying member 56, the dispersing members 57 and the spiral piece 56R is pushed upward in the container main body 51 by a rotational force of the agitating film 80. The toner pushed upward of the agitating film 80 moves in the first conveying direction to collapse a heap of the toner in the container main body 51 (see dotted line S of FIG. 13A) and is conveyed again in the second conveying direction by the second conveying member 56. In this way, the toner located above the rotary member 54M2 is caused to flow in a circulating manner by the rotation of the agitating film 80. Therefore, even in an environment where the fluidity of the toner is deteriorated, the tunnel-like condensation of the toner in the container main body 51 is suppressed.

Further, in this embodiment, a sensor 90 is arranged to face a position of the second side wall 513 where the free end portion 80*b* comes into contact as shown in FIGS. 13B and 14B. The sensor 90 is used to notify an exchange timing of the toner container 50 by detecting the toner stored in the toner container 50.

The sensor 90 is a plate-like magnetic sensor and outputs a voltage signal corresponding to the remaining amount of the toner in the toner container 50. Specifically, the sensor 90 outputs a high voltage if the toner is present at the position facing the sensor 90 while outputting a low voltage if the toner is absent. However, the toner may adhere to each inner surface of the toner container 50. If the toner in the toner container 50 is nearly used up with the toner adhering to the inner surface of the second side wall facing the sensor 90, the sensor 90 erroneously continues to output a high voltage. Thus, that the toner in the toner container 50 is used up cannot be correctly detected based on an output of the sensor 90.

Even in such a case, in this embodiment, the free end portion 80*b* of the agitating film 80 rotates while coming into contact with a part of the inner surface of the second side wall 513 facing the sensor 90. Thus, the free end portion 80*b* can scrape off the toner adhering to the inner surface of the second side wall 513. Therefore, erroneous detection of the amount of the toner in the toner container 50 is suppressed.

Although the toner container 50 and the image forming apparatus 1 according to the embodiment of the present disclosure have been described above, the present disclosure is not limited to this embodiment and can be, for example, modified as follows.

(1) In the above embodiment, the toner container 50 is illustrated as a specific example of the developer storage container. The developer storage container may be, for example, a developing unit formed by uniting a toner storage unit, a developing roller and the like or an intermediate hopper or the like interposed between the toner container and the developing device.

Figure 15B:
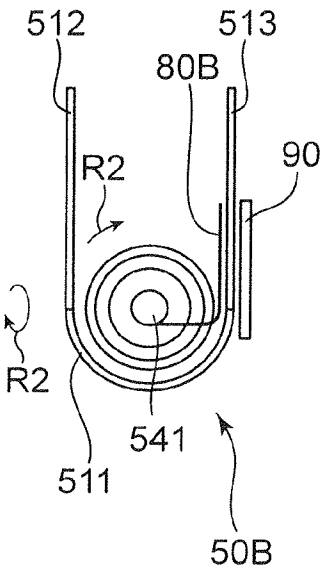
FIG. 15A is a schematic side view in section and FIG. 15B is a sectional view of a toner container including a rotary member according to a modification.
Figure 15A:
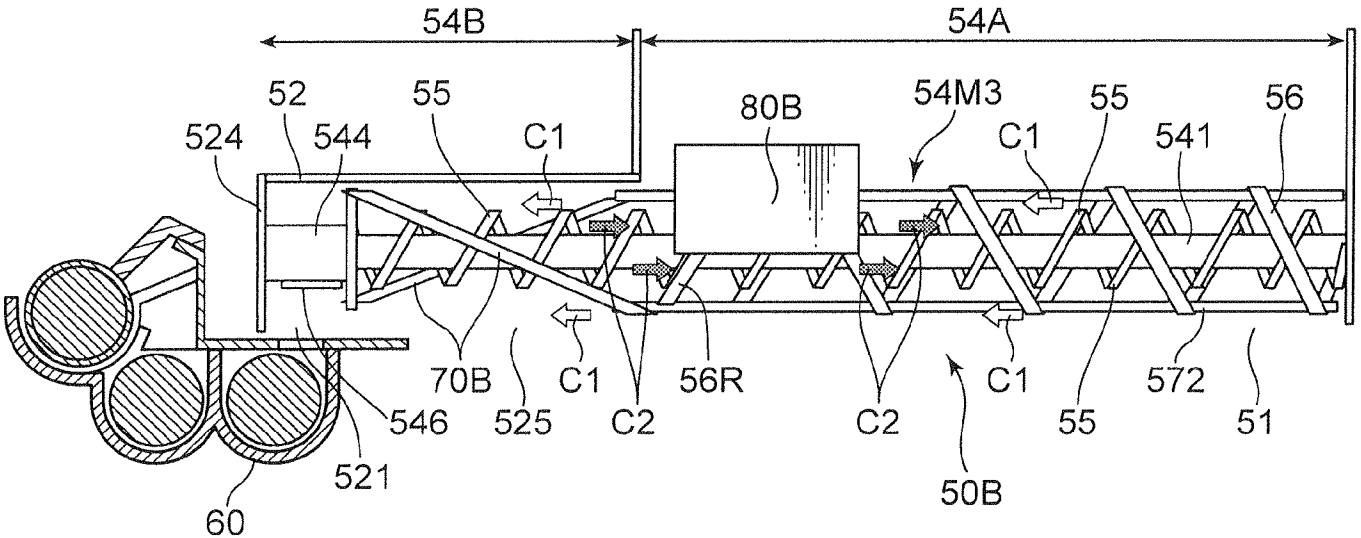

(2) In the above embodiment, the dispersing members 57 are formed over the entire axial length of the rotary shaft 541. Without being limited to this, the dispersing members 57 may be arranged only at the first section 54A. FIGS. 15A and 15B are a schematic side view in section and a sectional view of a toner container 50B including a rotary member 54M3 according to a modification. As shown, dispersing members 572 are formed around the peripheral surface of a rotary shaft 541 only at a first section 54A corresponding to a container main body 51 of the toner container 50B. Further, at a second section 54B corresponding to a tubular portion 52 of the toner container 50B, a pair of rectifying spirals 70B are arranged at opposite sides in a rotating circumferential direction. The pair of rectifying spirals 70B function to assist a movement of a toner conveyed in a second direction from the first section 54A toward a toner discharge opening 521. Even in the rotary member 54M3 thus constructed, an agitating film 80B causes a vertical circulating flow of the toner in the container main body 51. Thus, the tunnel-like condensation of the toner can be effectively suppressed.

(3) The rotary member 54M2 according to the previous embodiment, the agitating film 80 projects in the radial direction of the rotary shaft 541 in an area where the arched conveying pieces of the second conveying member 56 and the spiral piece 56R are arranged, out of an axial area of the rotary shaft 541 where the agitating film 80 is arranged. The arrangement of the agitating film 80 in the circumferential direction is not limited to this.

Figure 16B:
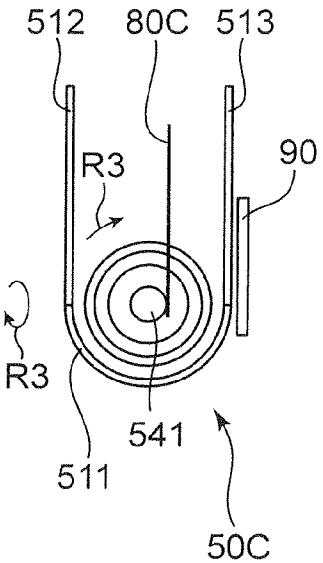
FIG. 16A is a schematic side view in section and FIG. 16B is a sectional view of a toner container including a rotary member according to another modification.
Figure 16A:
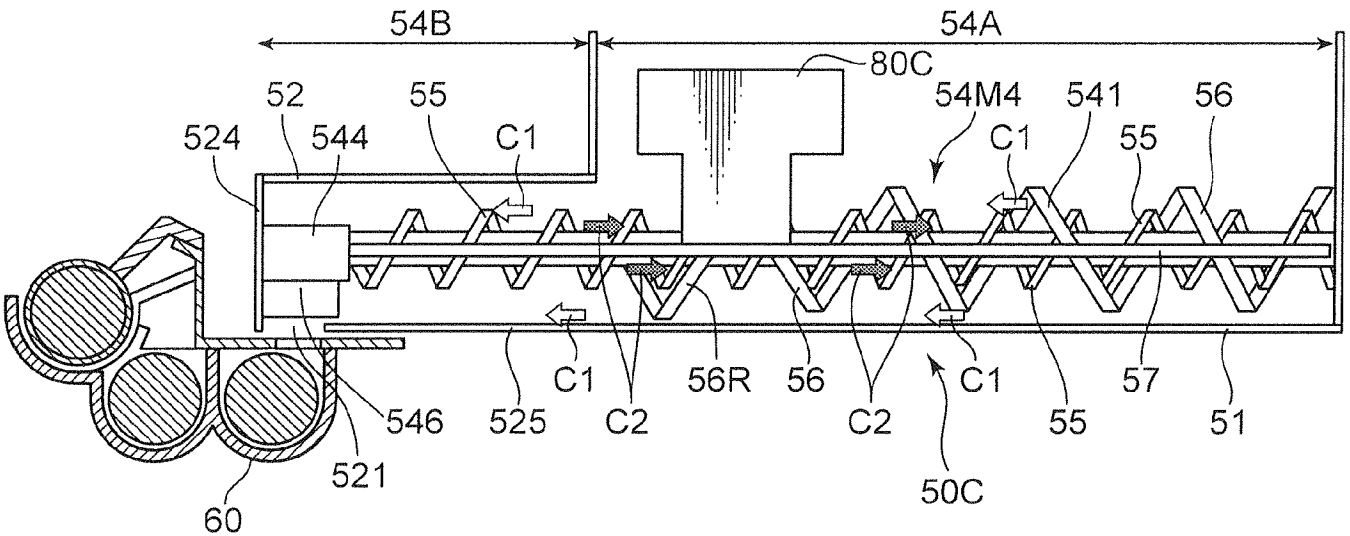

FIGS. 16A and 16B are a schematic side view in section and a sectional view of a toner container 50C including a rotary member 54M4 according to another modification. As shown, an agitating film 80C projects in a radial direction of a rotary shaft 541 in an area where arched conveying pieces of a second conveying member 56 and a spiral piece 56R are not arranged (above the rotary shaft 541 in FIGS. 16A and 16B), out of an axial area of the rotary shaft 541 where the agitating film 80C is arranged.

Even in the rotary member 54M4 thus constructed, an agitating film 80C causes a vertical circulating flow of the toner in the container main body 51 by being driven and rotated. Thus, the tunnel-like condensation of the toner can be effectively suppressed. Further, in this modification, it is difficult to form a closed space between the agitating film 80C and the arched conveying pieces of the second conveying member 56, the spiral piece 56R when the agitating film 80C rotates according to the rotation of the rotary shaft 541 while being deflected in the circumferential direction. In other words, the agitating film 80C rotating while being deflected does not hover over the toner located between the arched conveying pieces of the second conveying member 56 and the spiral piece 56R and inside the rotary member 54M4. Thus, condensation of the toner located at the inner sides of the second conveying member 56 and the spiral piece 56R is suppressed.

Example

Next, the result of an example carried out using the rotary member 54 according to the above embodiment is described. Note that the example was carried out under the following factors and conditions.

Rotary member: rotary member 54M2, number of revolutions: 120 rpm

First conveying member 55: diameter of 13 mm, spiral pitch of 15 mm, shaft diameter of 5 mm Second conveying member 56: maximum outer diameter of 21 mm, minimum outer diameter of 16 mm, inner diameter of 14 mm, spiral pitch of 20 mm Dispersing member 57: thickness of 1 mm in circumferential direction Toner Container 50:

Container main body 51: thickness of 17 mm, length of 100 mm

Tubular portion 52: inner diameter of 17 mm, length of 65 mm Agitating film 80:

Material: PPS (polyphenylene sulfide) resin film, thickness of 0.1 mm

After the shape of the agitating film 80 was changed under the above conditions, the tunnel-like condensation of the toner in the toner container 50 was evaluated.

TABLE 1

| | | | | | | | | |
|---|---|---|---|---|---|---|---|---|
| A (mm) | 6.5 | 12.5 | 13.0 | 17.5 | 22.5 | 27.5 | 25.0 | 28.0 |
| B (mm) | 5.5 | 5.0 | 5.0 | 4.5 | 4.0 | 3.0 | 2.5 | 2.5 |
| A/B | 1.18 | 2.50 | 2.60 | 3.89 | 5.63 | 9.17 | 10.00 | 11.20 |
| Result | Occurrence of tunnel-like condensation | | ○ | ○ | ○ | ○ | Occurrence of Torque Increase | |

As shown in TABLE-1, it was found to be preferable to satisfy $2.5<A/B<10$, ($B=L-A$) on a cross-section of the agitating film 80 according to this example perpendicular to the rotary shaft 541. Note that L denotes the entire length of the agitating film 80 in an extending direction, A denotes a length of a part of the free end portion 80*b* that comes into contact with the first side wall 512 or the second side wall 513 (see FIG. 14B). By satisfying the above range, a torque increase of the rotary shaft caused by the contact of the agitating film 80 with the first side wall 512 or the second side wall 513 was suppressed and the tunnel-like condensation of the toner was suppressed.

As described above, according to the present disclosure, the tunnel-like condensation of the developer stored in the container main body can be suppressed. Thus, it is possible to provide a developer storage container capable of discharging a developer stored in a container main body without leaving the developer and an image forming apparatus to which this developer storage container is applied.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer storage container, comprising:

a container main body including a bottom wall extending in one direction and configured to store a developer, a first side wall extending up from a first end edge of the bottom wall, a second side wall extending up from a second end edge of the bottom wall and facing the first side wall and a ceiling wall disposed over the bottom wall and above a tubular portion;

the tubular portion projecting from the container main body while being connected to the bottom wall, and including a developer discharge opening; and a rotary member extending from the container main body to the tubular portion and having a function of conveying the developer in the container main body;

wherein:

the rotary member includes:

a rotary shaft extending in an extending direction of the bottom wall and having a circumferential surface, the rotary shaft including a first section located in the container main body and a second section located in the tubular portion;

a first conveying member arranged on the circumferential surface of the second section of the rotary shaft and configured to rotate together with the rotary shaft and convey the developer in a first conveying direction from the tubular portion toward the container main body;

a second conveying member arranged around the first section and at a side radially outward of the first conveying member and configured to rotate together with the rotary shaft and convey the developer in a second conveying direction from the container main body toward the tubular portion; and a flexible member including a fixed end portion fixed onto the circumferential surface of the rotary shaft near a downstream end of the first section in the second conveying direction, the flexible member extending from the circumferential surface of the first section of the rotary shaft in a direction perpendicular to an axial direction of the rotary shaft and having a free end portion arranged at a side radially outward of the second conveying member, the free end portion of the flexible member passes a position under the ceiling wall and above the tubular portion in the container main body after successively contacting an inner surface of the first side wall and an inner surface of the second side wall when the fixed portion of the flexible member is rotated together with the rotary shaft, and an elastic force of the free end portion of the flexible member being released and acting to flip the developer around the free end portion upwardly when the free end portion moves away from the inner surface of the second side wall.

2. A developer storage container according to claim 1, wherein:

the first conveying member is a conveying member spirally projecting on the circumferential surface of the rotary shaft; and the second conveying member is a spiral conveying member including a hollow portion into which the rotary shaft with the first conveying member is insertable.

3. A developer storage container according to claim 2, wherein:

the tubular portion has an inner wall surface having a circular cross-section; and the bottom wall of the container main body has a semicircular inner wall surface corresponding to a rotation path of a most radially projecting part of the second conveying member and the semicircular inner wall surface is connected to the circular inner wall surface of the tubular portion.

4. A developer storage container according to claim 3, further comprising a sensor for detecting the developer stored in the developer storage container, wherein:

the sensor is mounted to face a position of the first or second side wall where the free end portion of the flexible member comes into contact.

5. A developer storage container according to claim 3, wherein:

the flexible member satisfies the following inequality:

$$2.5<A/(L-A)<10,$$

when L denotes the entire length of the flexible member in an extending direction in a cross-section perpendicular to the rotary shaft and A denotes a length of the free end portion side that comes into contact with the first or second side wall.

6. A developer storage container according to claim 2, wherein:

an axial length of the free end portion of the flexible member is longer than that of the fixed end portion.

7. A developer storage container according to claim 2, wherein:

the flexible member projects in a radial direction of the rotary shaft in an area where a spiral of the second conveying member is not arranged, out of an axial area of the rotary shaft where the flexible member is arranged.

8. A developer storage container according to claim 2, further comprising:

a spiral piece having a function of conveying the developer in the first conveying direction and arranged at a predetermined distance in the second direction from a spiral of the second conveying member on the first section.

9. A developer storage container according to claim 8, wherein:

the flexible member is arranged at a side of the second conveying member in the second conveying direction and a side of the spiral piece in the first conveying direction in the axial direction of the rotary shaft, and projects in a radial direction of the rotary shaft in an area where the spiral of the second conveying member and the spiral piece are not arranged, out of an axial area of the rotary shaft.

10. A developer storage container according to claim 1, wherein:

the rotary member includes a dispersing member arranged over both the first and second sections, the rotary member being a rod-like member and extending along the axial direction of the rotary shaft.

11. An image forming apparatus, comprising:

an image bearing member for bearing a developer image on the circumferential surface thereof;

a developing device including a developing roller for supplying the developer to the circumferential surface of the image bearing member; and a developer storage container to be assembled with the developing device for supplying the developer to the developing device;

wherein the developer storage container includes:

a container main body including a bottom wall extending in one direction and configured to store a developer, a first side wall extending up from a first end edge of the bottom wall, a second side wall extending up from a second end edge of the bottom wall and facing the first side wall and a ceiling wall disposed over the bottom wall and above a tubular portion;

the tubular portion projecting from the container main body while being connected to the bottom wall, and including a developer discharge opening; and a rotary member extending from the container main body to the tubular portion and having a function of conveying the developer in the container main body;

the rotary member including:

a rotary shaft extending in an extending direction of the bottom wall and having a circumferential surface, the rotary shaft including a first section located in the container main body and a second section located in the tubular portion;

a first conveying member arranged on the circumferential surface of the second section of the rotary shaft and configured to rotate together with the rotary shaft and convey the developer in a first conveying direction from the tubular portion toward the container main body;

a second conveying member arranged around the first section and at a side radially outward of the first conveying member and configured to rotate together with the rotary shaft and convey the developer in a second conveying direction from the container main body toward the tubular portion; and a flexible member including a fixed end portion fixed onto the circumferential surface of the rotary shaft near a downstream end of the first section in the second conveying direction, the flexible member extending from the circumferential surface of the first section of the rotary shaft in a direction perpendicular to an axial direction of the rotary shaft and having a free end portion arranged at a side radially outward of the second conveying member, the free end portion of the flexible member passes a position under the ceiling wall and above the tubular portion in the container main body after successively contacting an inner surface of the first side wall and an inner surface of the second side wall when the fixed portion of the flexible member is rotated together with the rotary shaft, and an elastic force of the free end portion of the flexible member being released and acting to flip the developer around the free end portion upwardly when the free end portion moves away from the inner surface of the second side wall.

12. An image forming apparatus according to claim 11, wherein:

the first conveying member is a conveying member spirally projecting on the circumferential surface of the rotary shaft; and the second conveying member is a spiral conveying member including a hollow portion into which the rotary shaft with the first conveying member is insertable.

13. An image forming apparatus according to claim 12, wherein:

the tubular portion has an inner wall surface having a circular cross-section;

the bottom wall of the container main body has a semicircular inner wall surface corresponding to a rotation path of a most radially projecting part of the second conveying member and the semicircular inner wall surface is connected to the circular inner wall surface of the tubular portion.

14. An image forming apparatus according to claim 13, further comprising a sensor for detecting the developer stored in the developer storage container, wherein:

the sensor is mounted to face a position of the first or second side wall where the free end portion of the flexible member comes into contact.

15. An image forming apparatus according to claim 13, wherein:

the flexible member satisfies the following inequality:

$$2.5<A/(L-A)<10,$$

when L denotes the entire length of the flexible member in an extending direction in a cross-section perpendicular to the rotary shaft and A denotes a length of the free end portion side that comes into contact with the first or second side wall.

16. An image forming apparatus according to claim 12, wherein:

an axial length of the free end portion of the flexible member is longer than that of the fixed end portion.

17. An image forming apparatus according to claim 12, wherein:

the flexible member projects in a radial direction of the rotary shaft in an area where a spiral of the second conveying member is not arranged, out of an axial area of the rotary shaft where the flexible member is arranged.

18. An image forming apparatus according to claim 12, further comprising:

a spiral piece having a function of conveying the developer in the first conveying direction and arranged at a predetermined distance in the second direction from a spiral of the second conveying member on the first section.

19. An image forming apparatus according to claim 18, wherein:

the flexible member is arranged at a side of the second conveying member in the second conveying direction and a side of the spiral piece in the first conveying direction in the axial direction of the rotary shaft, and projects in a radial direction of the rotary shaft in an area where the spiral of the second conveying member and the spiral piece are not arranged, out of an axial area of the rotary shaft.

* * * * *